US006997302B2

(12) United States Patent
Fargo et al.

(10) Patent No.: US 6,997,302 B2
(45) Date of Patent: Feb. 14, 2006

(54) ESCALATOR DRIVE MECHANISM WITH FAILURE DETECTION AND BACKUP

(75) Inventors: Richard N. Fargo, Plainville, CT (US); Jorg Ostermeier, Buckeburg (DE); Charles Darling, New Britain, CT (US); Bernward Engelke, Hildesheim (DE); Ernst Führing, Lindhorst (DE); John Michael Milton-Benoit, Springfield, MA (US)

(73) Assignee: Otis Elevator Company, Farmington, CT (US)

( * ) Notice: Subject to any disclaimer, the term of this patent is extended or adjusted under 35 U.S.C. 154(b) by 0 days.

(21) Appl. No.: 10/514,532

(22) PCT Filed: May 20, 2002

(86) PCT No.: PCT/US02/16172

§ 371 (c)(1),
(2), (4) Date: Nov. 12, 2004

(87) PCT Pub. No.: WO03/099686

PCT Pub. Date: Dec. 4, 2003

(65) Prior Publication Data

US 2005/0258016 A1 Nov. 24, 2005

(51) Int. Cl.
*B66B 23/02* (2006.01)

(52) U.S. Cl. ..... 198/330; 198/323

(58) Field of Classification Search ..... 198/323, 198/330, 333, 331
See application file for complete search history.

(56) References Cited

U.S. PATENT DOCUMENTS

| | | | | |
|---|---|---|---|---|
| 5,024,314 | A | 6/1991 | Kitamura et al. | |
| 5,090,551 | A * | 2/1992 | Yasuhara et al. | 198/323 |
| 6,234,295 | B1 | 5/2001 | Ogawa | |
| 6,427,823 | B1 | 8/2002 | Ishikawa et al. | |
| 6,457,573 | B1 * | 10/2002 | Ostermeier et al. | 198/330 |
| 6,527,099 | B1 * | 3/2003 | Ostermeier et al. | 198/330 |

OTHER PUBLICATIONS

PCT International Search Report dated Mar. 26, 2003.

* cited by examiner

*Primary Examiner*—James R. Bidwell
(74) *Attorney, Agent, or Firm*—Carlson, Gaskey & Olds

(57) ABSTRACT

An escalator drive assembly includes a backup member (40) that facilitates controlling movement of the escalator (20) even when the normal drive assembly operation is interrupted. A backup member (40) in the form of a flange (42) is associated with a drive pulley (34) and normally rotates in unison with the drive pulley (34). When there is a failure in the normal operation of the drive mechanism, however, there is a resulting relative movement between the backup member (40) and the drive pulley (34). Such relative motion preferably activates a switch (80) that provides a signal that indicates a failure of the normal operation of the drive mechanism. The backup member (40) facilitates providing an indication of a failure and control over movement of the escalator (20) even when the normal drive assembly is not operating as intended.

20 Claims, 6 Drawing Sheets

ESCALATOR DRIVE MECHANISM WITH FAILURE DETECTION AND BACKUP

BACKGROUND OF THE INVENTION

This invention generally relates to escalator drive mechanisms. More particularly, this invention relates to a failure detection and backup arrangement for use in an escalator drive mechanism.

Escalators are passenger conveyors that typically carry passengers between landings at different levels in buildings, for example. A chain of steps typically is driven using a motorized assembly. There are a variety of motorized assemblies proposed or currently in use. There are several possible ways in which the drive torque from the motor to the step chain can be interrupted.

When there is a failure of drive transmission between the motor and the step chain, there is a need to control the position of the escalator steps. Without the motive force of the motor, normal gravitational forces may cause undesirable movement of the escalator steps, for example. There is a need for an arrangement that controls movement of the escalator step chain and steps even under conditions when the normal drive mechanism cannot operate as normally intended.

This invention provides a mechanism for controlling the movement of the escalator even under conditions where the normal drive arrangement cannot operate as intended. Additionally, this invention provides an indication of when the normal drive operation has failed.

SUMMARY OF THE INVENTION

In general terms, this invention is a passenger conveyor drive assembly that includes a backup member for controlling movement or position of the conveyor even when the normal drive assembly cannot operate as intended.

An assembly designed according to this invention includes a motor and a drive member that rotates responsive to a motive force from the motor. A driven member has a first portion that is engaged by the drive member such that the driven member moves responsive to movement of the drive member. When the driven member moves, that results in movement of the passenger conveyor. The backup member rotates in unison with the drive member under normal operating conditions. The backup member engages a second portion of the driven member and permits control over the driven member responsive to relative movement between the drive member and the driven member.

In one example, the drive member comprises a drive pulley and drive belt. The driven member comprises a step chain, which has a plurality of links. Teeth on the drive belt engage corresponding teeth on the step chain during normal operation. In the event of a failure of the transmission of a drive force from the drive member to the driven member, at least one of the step chain links engages the backup member. Under these circumstances, the backup member, which in one example is a flange associated with the drive pulley, moves relative to the drive pulley a selected amount and then facilitates the necessary control of the escalator.

When there is relative movement between the drive member and the driven member, that is an indication of a failure of the normal operation of the drive mechanism. In such circumstances, the backup member preferably engages the driven member and provides a way of controlling movement of the driven member and consequently the escalator.

In one example, movement of the backup member relative to drive member activates a switch that provides a signal indicating failure of the normal, expected operation of the escalator drive assembly. In one example, the switch serves to activate a brake for stopping the escalator system.

The various advantages and features of this invention will become apparent to those skilled in the art from the following detailed description of the currently preferred arrangement. The drawings that accompany the detailed description can be briefly described as follows.

DETAILED DESCRIPTION OF THE PREFERRED EMBODIMENTS

Figure 1:
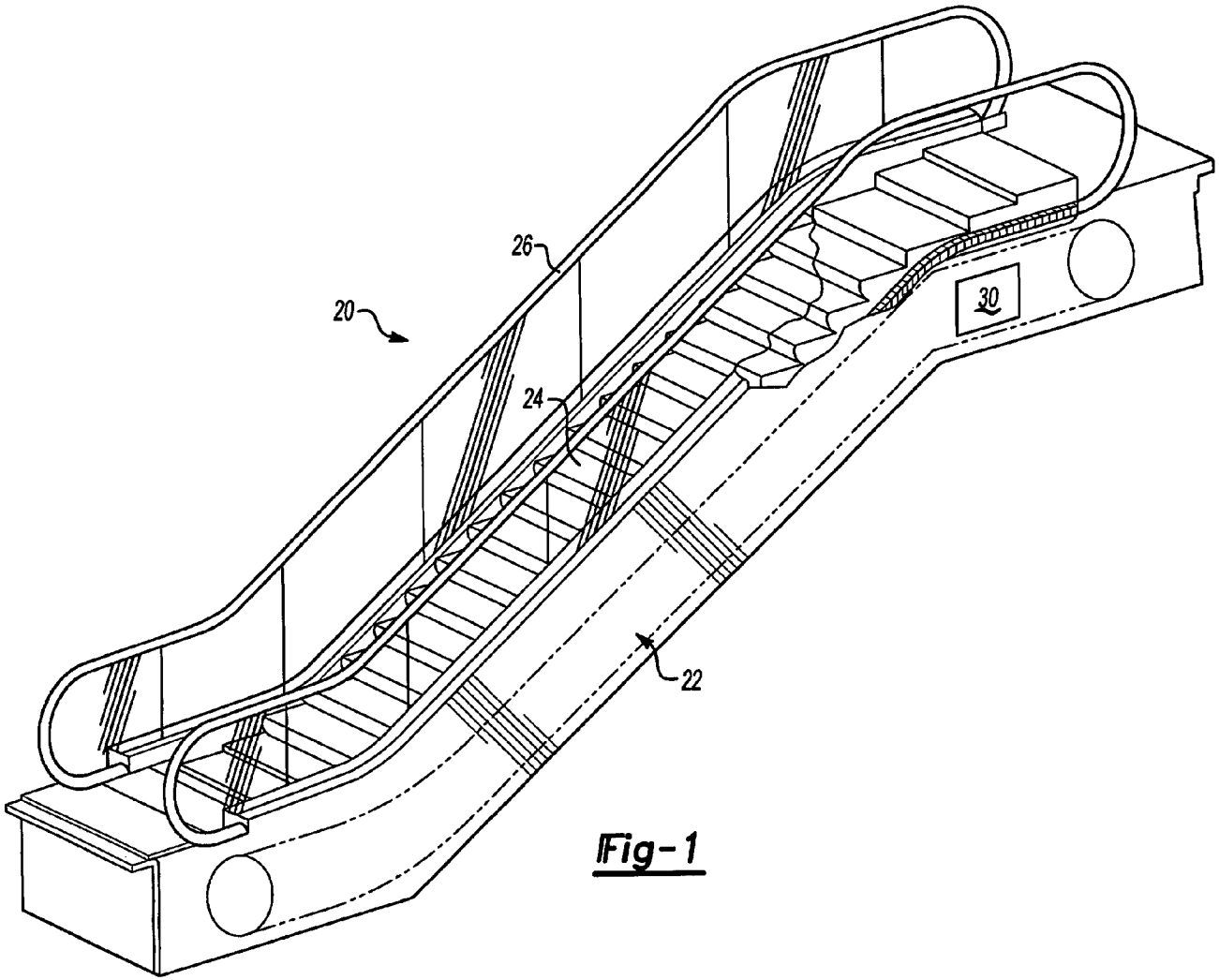
FIG. 1 diagrammatically illustrates an escalator system designed according to this invention.

An escalator system 20 is shown in FIG. 1 that includes a conventional escalator support structure 22 for supporting a plurality of steps 24 and a hand rail 26 to move passengers between floors in a building, for example. A drive mechanism 30 operates to move the steps 24 in a chosen direction at a desired speed under normal operating conditions.

Figure 2A:
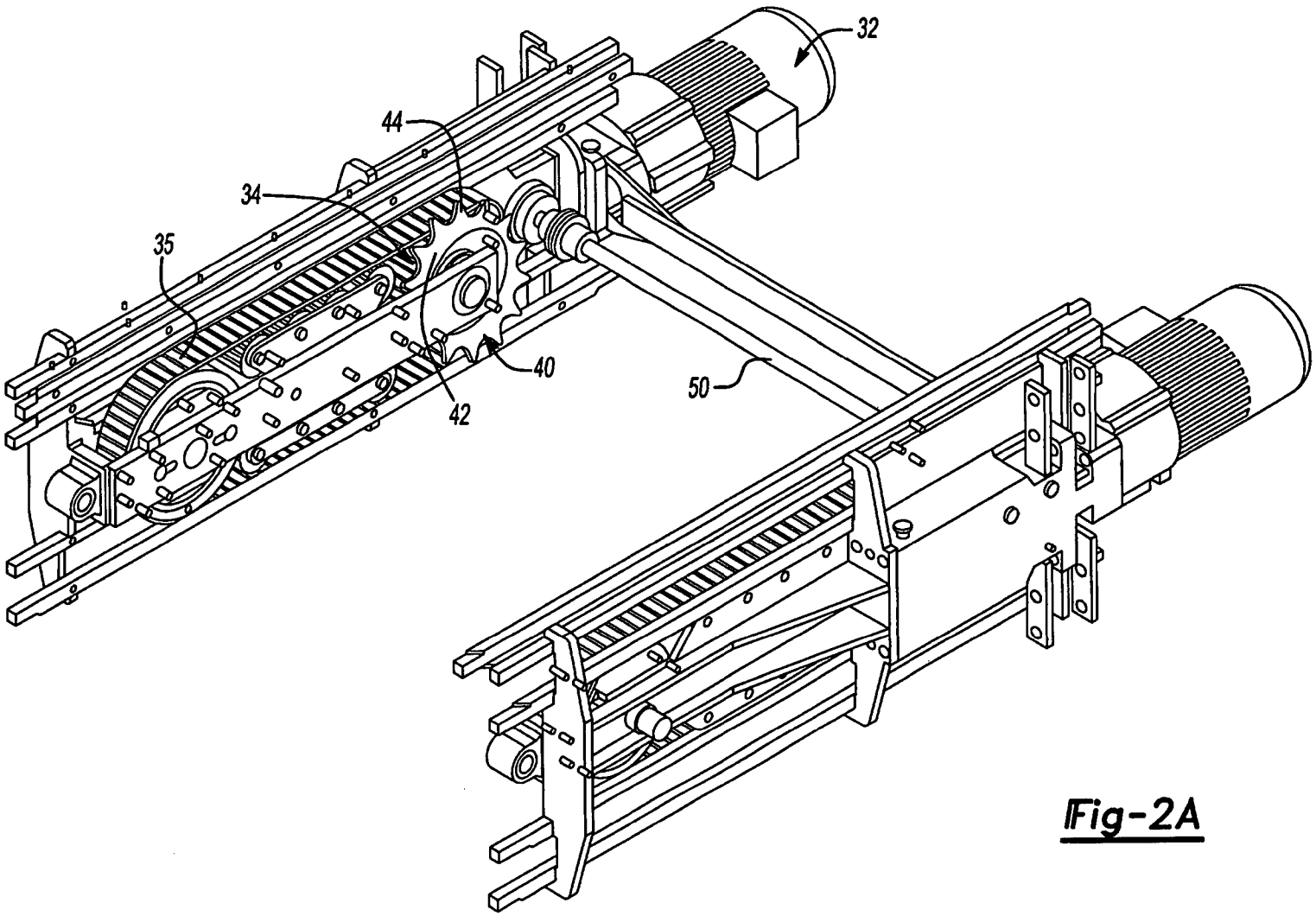
FIGS. 2A and 2B illustrate in somewhat more detail selected components of an example escalator drive assembly designed according to this invention.
Figure 2B:
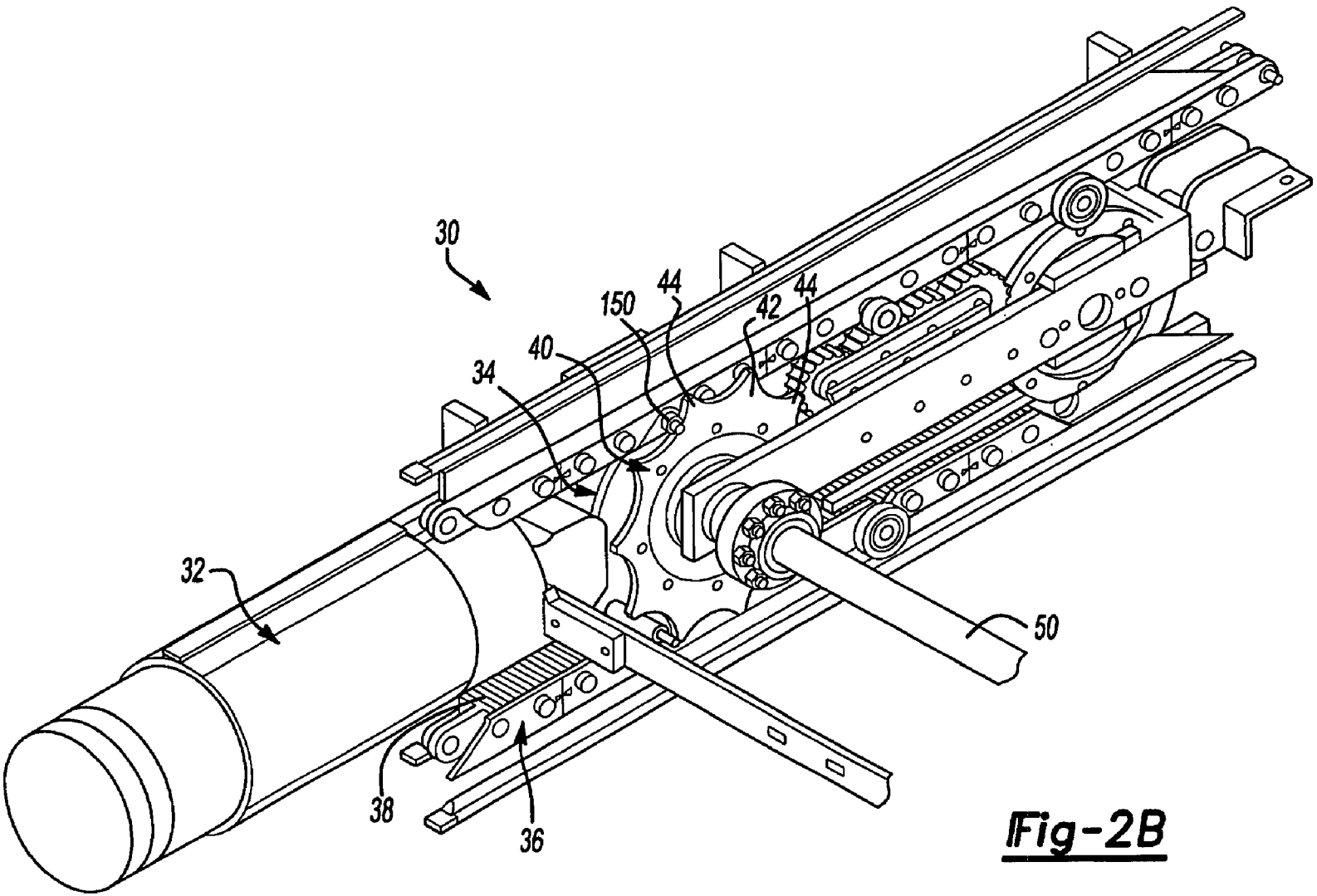

Referring to FIGS. 2A and 2B, for example, the drive mechanism 30 includes a motor assembly 32 that preferably has a motor and a brake. The motor 32 provides a motive force to a drive pulley 34. A cogged belt 35 (FIG. 2A) preferably is driven by the motor 32 and drive pulley 34. The motive force on the belt 35 preferably is transferred to a plurality of step chain links 36. In one example, the belt is cogged to engage a plurality of cooperatively shaped teeth 38 on the step chain links 36. Under normal operating conditions, the belt 35 and the step chain links 36 move in unison, based upon the speed of movement of the drive pulley 34.

The illustration of FIG. 2A shows the drive belt 35 while the illustration of FIG. 2B shows the step chain links 36. The drive belt 35 and step chain links 36 are included in an operative arrangement. The engagement between the teeth on the drive belt 35 and the corresponding teeth 38 on the step chain links 36 provides the movement of the escalator steps as the step chain links 36 are associated with the steps in a manner sufficient to cause such movement. Accordingly, the step chain links 36 preferably follow the entire path of the steps while the drive belt 35 travels around a much shorter loop as can be appreciated from FIG. 2A, for example.

A synchronizer bar 50 extends approximately the width of the steps so that drive belts 35 and sets of step chain links 36 associated with the edges of the steps, respectively, move synchronously to provide smooth and reliable operation of the conveyor.

The inventive arrangement includes a backup member 40 associated with the drive pulley 34. The backup member 40 preferably includes a flange body portion 42 with a plurality of radially extending arm portions 44. In the illustrated example, the backup member 40 is generally star-shaped.

Under normal operating conditions, the backup member 40 rotates in unison with the drive pulley 34 and has no effect on step chain movement. When there is a failure in the normal operation of the drive mechanism, however, there is relative movement between the drive pulley 34 and the step chain links 36. Under such circumstances, a portion of at least one of the step chain links 36 engages at least one of the radially extending portions 44 on the backup member 40. This results in at least some relative movement between the drive pulley 34 and the backup member 40. Such relative motion between the drive pulley 34 and the backup member 40 instigates an indication that the drive assembly has failed to operate as normally desired.

Figure 3:
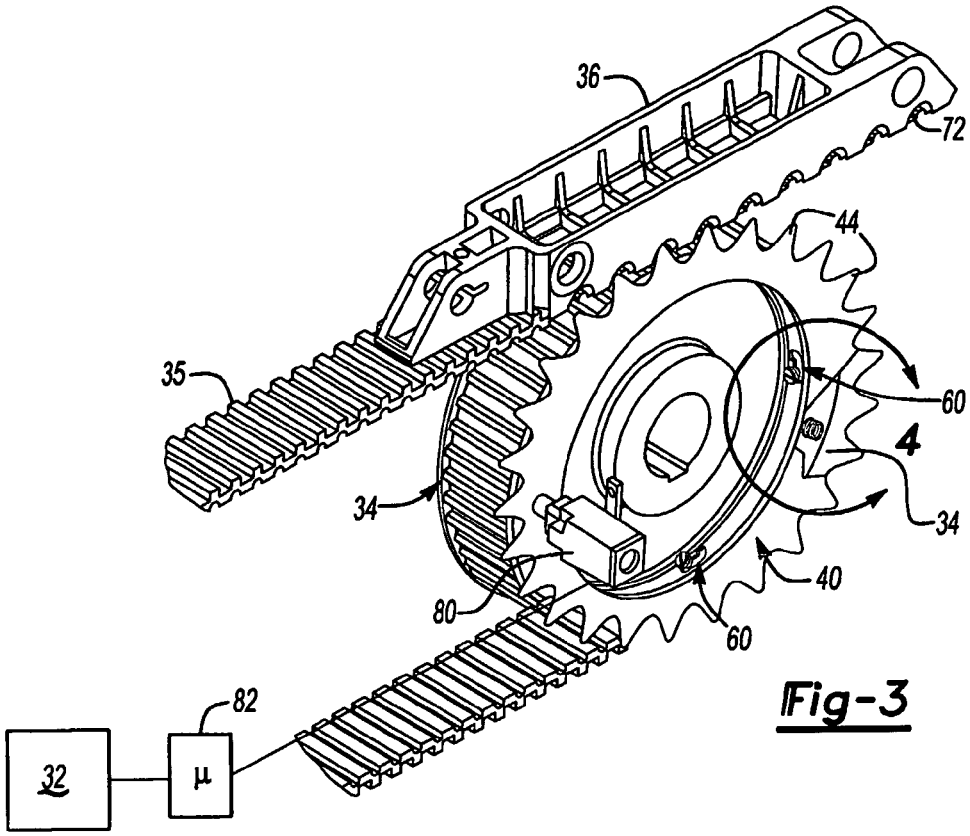
FIG. 3 illustrates selected portions of the embodiment of FIGS. 2A and 2B.
Figure 4:
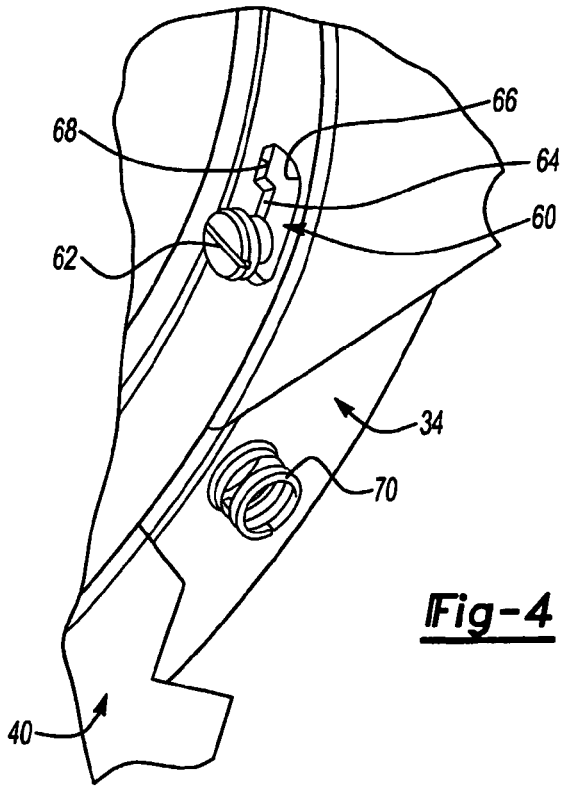
FIG. 4 illustrates, in somewhat more detail, the portion of FIG. 3 encircled in the circle labeled 4.

One example arrangement that utilizes limited relative movement between the backup member 40 and the drive pulley 34 is illustrated in FIGS. 3 and 4. In this example, the backup member 40 normally rotates with the drive pulley 34. A synchronization arrangement 60 keeps the two rotating together under normal operating conditions.

The backup member 40 preferably is initially oriented relative to the drive pulley so that a stop member 62, which is a bolt secured to the drive pulley 34 in the illustrated example, is positioned against a support surface 64 within a generally arcuate slot 66 formed on the backup member 40. The support surface 64 preferably includes a partially rounded contour to stabilize the bolt 62 against the surface 64.

A spring 70 which normally biases the backup member 40 away from the drive pulley 34 in a direction parallel to the axis of rotation of the drive pulley. In the initial normal operating position, the spring 70 operates to assist maintaining the bolt 62 on the support surface 64. The contour of the surface 64 and the bias of the spring 70 preferably are set so that a desired minimal amount of force is required to cause movement of the bolt 62 within the slot 66.

As can be appreciated from FIGS. 3 and 4, a plurality of the synchronizing arrangements 60 preferably are provided spaced about on the drive pulley 34 and backup member 40.

When there is relative movement between the step chain links 36 and the drive pulley 34, engagement between the backup member 40 and the step chain links 36 causes relative movement between the drive pulley 34 and the backup member 40. Depending on the direction of such relative movement, the bolt 62 becomes removed from the surface 64 such that it slides into one of the ends 68 of the generally arcuate slot 66. Such movement of the bolt 62 within the slot 66 is the result of the relative rotary movement between the drive pulley 34 and the backup member 40.

Once the bolt 62 is in one of the ends 68 of the slot 66, the bolt is situated so that the drive pulley 34 and backup member 40 once again move synchronously or remain stopped together, depending on the operation of the motor and brake assembly 32.

Figure 5:
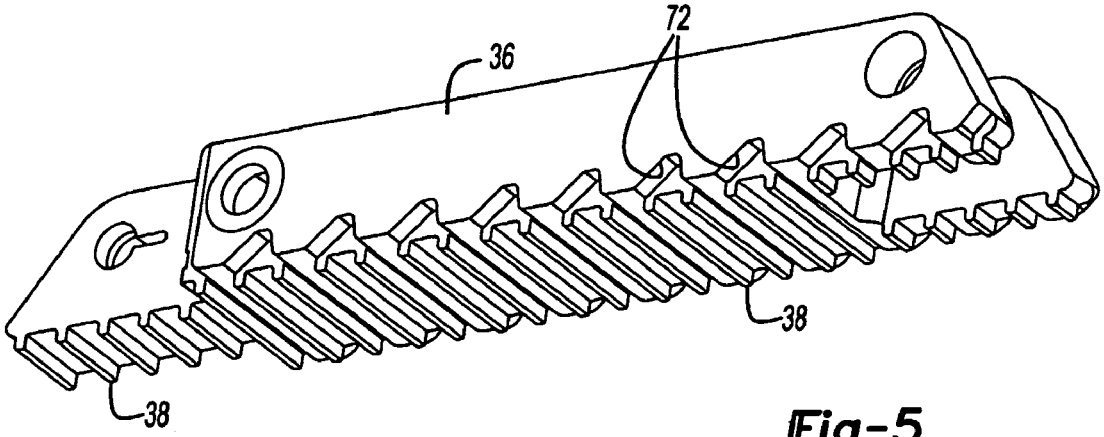
FIG. 5 illustrates selected features of the step chain links used in the example of FIG. 3.

In the examples of FIGS. 3 through 5, the radial projections 44 on the backup member 40 preferably cooperate with reference surfaces 72 that are formed on the step chain links 36. Under normal operating conditions, the radial projections 44 follow the reference surfaces 72. When there is relative movement between the drive pulley 34 and the step chain links 36, the cooperation between the reference surfaces 72 and the radial projections 44 causes the relative movement between the drive pulley 34 and the backup member 40. In one example, the teeth 38 on the step chain links 36 are formed during a casting process while the reference surfaces 72 are machined in separately.

The backup member 40, which is again synchronized with the drive pulley 34, allows the drive assembly 30 to once again control movement of the step chain links to once again control movement of the step chain links 36. In this condition the backup member 40 imparts the motive force of the motor to the step chain links.

The spring 70 causes relative outward movement of the backup member 40 further away from the drive pulley 34 as the bolt 62 moves into an end 68 of the slot 66. Such movement preferably activates a switch 80. The switch 80 preferably is positioned relative to the backup member in such an embodiment so that the switch becomes activated at the time that there is relative movement between the step chain links 36 and the drive pulley 34. Activation of the switch 80, therefore, provides an indication of some failure in the drive connection between the drive pulley 34 and the step chain links 36.

In the illustrated example, an electrical signal generated by the switch 80 is received by a controller 82 that controls operation of the motor and brake assembly 32. In one example, the controller 82 is an integral part of the motor assembly. The controller 82 preferably controls the operation of the motor assembly and brake to ensure that the escalator steps 24 do not move in an undesirable fashion after the normal operation of the drive assembly has been interrupted.

The controller 82 may be, for example, a conventional microprocessor that is suitably programmed to interpret signals from the switch 80 and to correspondingly control the motor and brake assembly 32. In one example, the controller 82 is part of a controller already associated with the escalator system. In another example, the controller 82 is a dedicated microprocessor. Given this description, those skilled in the art will be able to choose from among commercially available components and to suitably program a computer or controller to perform the functions required to realize the results provided by this invention.

In another example, such as shown in FIG. 2B, the radial projections 44 cooperate with one or more pins 150 associated with the step chain links 36. In this example, some of the pins 150 can be portions of axles or pins that interconnect the plurality of step chain links 36. As can be appreciated, a variety of configurations are within the scope of this invention for causing cooperative movement between the step chain links 36 and the backup member 40.

Figure 6:
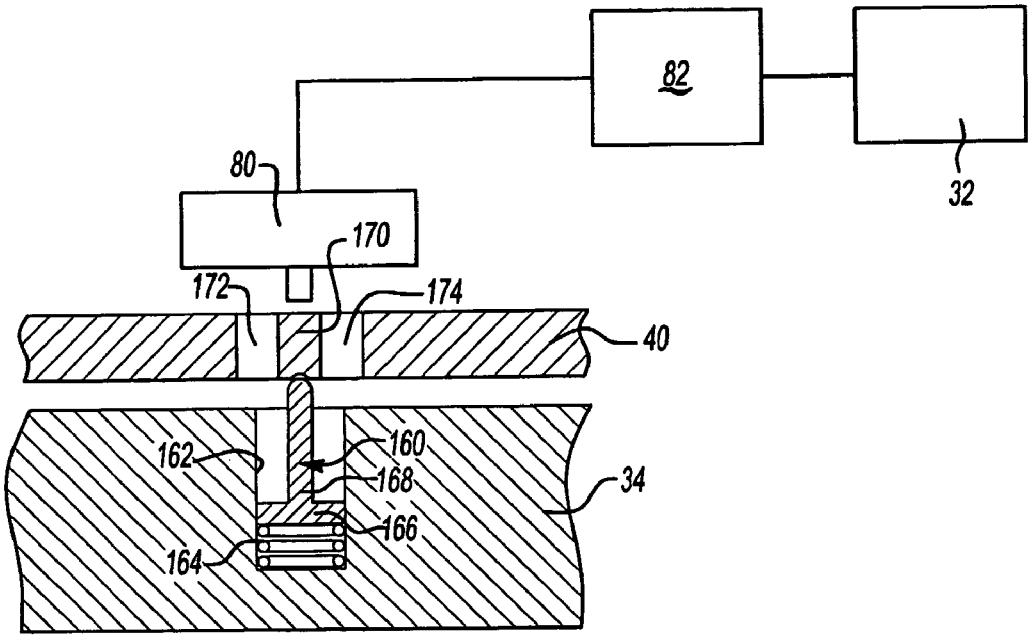
FIG. 6 illustrates selected components of another switch activating embodiment in a first position.
Figure 7:
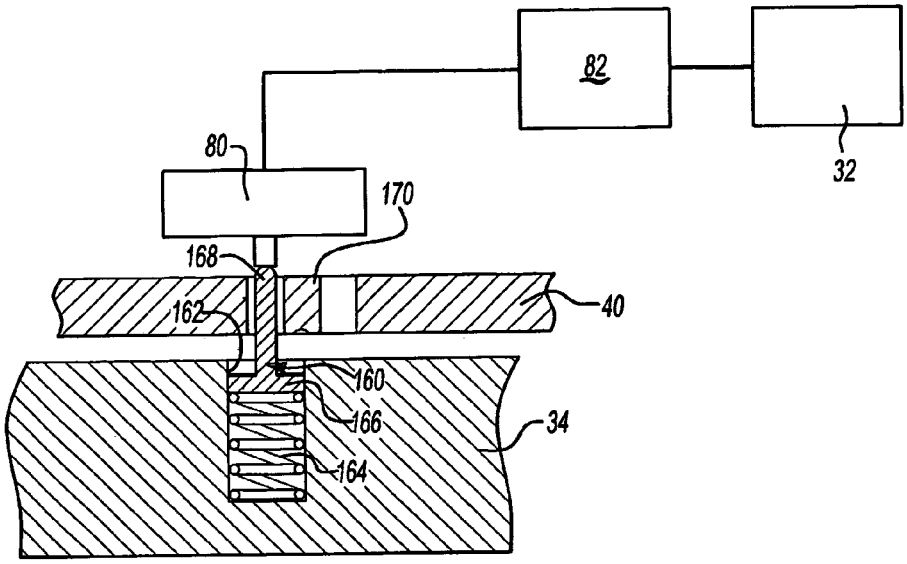
FIG. 7 illustrates the components of FIG. 6 in a second position.

Another example switch activating strategy is illustrated in FIGS. 6 and 7. In this example, a pin 160 cooperates with the switch 80 rather than cooperation directly between the flange portion of the backup member 40 and the switch 80 as occurs in the previously discussed example.

The drive pulley 34 in this example preferably supports a pin 160 within a receiver portion 162, which may be a bore in the drive pulley, for example. A biasing member 164, such as a spring, urges the pin 160 in a direction out of the receiver portion 162. The illustrated example of the pin 160 includes a base portion 166 and an extending arm 168.

FIG. 6 illustrates the pin 160 in a first position within the receiver portion 162. A solid portion 170 on the backup member 40 maintains the pin 160 in a recessed position within the receiver portion 162. An opening 172 is provided on one side of the solid portion 170 while a second opening 174 is provided on an opposite side. When there is relative rotation between the backup member 40 and the drive pulley 34, the pin arm 168 is biased out of the receiver portion 162 and through a corresponding opening 172 or 174. This can be appreciated from FIG. 7, for example.

In one example, the pin base 166 and arm 168 are structurally stable enough to support the backup member 40 relative to the drive pulley 34 so that any further movement of the drive pulley 34 by the motor 32 results in movement of the backup member 40 to control movement of the escalator. In such an example, the pin 160 may work alone or in combination with a synchronizing arrangement 60 as previously discussed.

Figure 8:
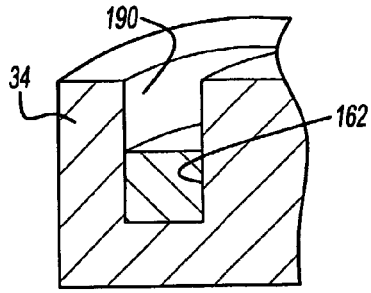
FIG. 8 diagrammatically illustrates a selected feature of another example drive member designed according to this invention.

In another example, the pin 160 is allowed to slide within a slot in the drive pulley 34 after the pin has extended through one of the openings in the backup member 40. Such an arrangement is schematically illustrated in FIG. 8 where a portion of the drive pulley 34 is shown. The receiver portion 162 extends a first depth into the drive pulley 34. An arcuate groove 190 is coincident with the receiver portion 162 but does not extend as deep into the body of the drive pulley 34. Therefore, when the pin is in a first position as illustrated in FIG. 6, it is maintained in the receiver portion 162. After the pin 160 has extended through an opening in the backup member 40, however, the base 166 is free to slide within the groove 190 so that there can be a desired amount relative rotation between the drive pulley 34 and the backup member 40. Such relative rotation with the pin 160 in the groove 190 prevents the pin from being broken or sheared as a result of any forces that would cause relative movement between the backup member 40 and the drive pulley 34. An arrangement such as that shown in FIGS. 3 and 4 could be used to cause the backup member 40 to again move with the drive pulley 34.

This invention provides a unique backup and failure indicator arrangement for escalator drive mechanisms. This invention is especially useful for escalator drive mechanisms that include a drive belt that is actuated by a drive pulley but not limited to such arrangements.

The preceding description is exemplary rather than limiting in nature. Variations and modifications to the disclosed examples may become apparent to those skilled in the art that do not depart from the essence of this invention. The scope of legal protection given to this invention can only be determined by studying the following claims.

What is claimed is:

1. A passenger conveyor drive assembly, comprising:

a motor;

a drive member that rotates responsive to a motive force from the motor;

a driven member having a first portion that is engaged by the drive member such that the driven member moves responsive to movement of the drive member, movement of the driven member resulting in movement of the passenger conveyor; and a backup member that rotates in unison with the drive member, the backup member engaging a second portion of the driven member responsive to relative movement between the drive member and the driven member.

2. The assembly of claim 1, including a brake associated with the motor and wherein the brake is activated responsive to relative movement between the drive member and the backup member.

3. The assembly of claim 2, including a brake switch and an actuator and wherein the relative movement between the backup member and the drive member causes the actuator to actuate the brake switch.

4. The assembly of claim 3, wherein the actuator includes a pin associated with the drive member that is biased into an actuating position and wherein the backup member maintains the pin out of the actuating position when the backup member moves with the drive member but releases the pin to move into the actuating position responsive to relative movement between the drive member and the backup member.

5. The assembly of claim 3, wherein the backup member has a flange portion that operates as the actuator.

6. The assembly of claim 1, wherein the driven member comprises a step chain and the second portion includes a pin that protrudes at least partially away from the chain, the backup member including at least one engagement surface that engages the pin.

7. The assembly of claim 1, wherein the backup member includes a plurality of radial projections, at least one of the projections engaging the second portion of the driven member responsive to relative movement between the drive member and the driven member.

8. The assembly of claim 7, wherein the second portion includes a plurality of reference surfaces on the step chain.

9. The assembly of claim 1, wherein the motor drives the backup member when the backup member engages the second portion of the driven member.

10. The assembly of claim 1, wherein the drive member includes a drive belt having a cogged surface and the driven member includes a plurality of step chain links each having teeth that correspond to the cogged surface on the drive belt.

11. The assembly of claim 1, including a stop member that moves with the drive member, the backup member including a generally arcuate slot through which at least a portion of the stop member is received, the stop member moving from a first position where the backup member and the drive member move synchronously into a second position within the generally arcuate slot responsive to relative movement between the drive member and the driven member.

12. The assembly of claim 11, including a biasing member that biases the backup member away from the drive member, the biasing member causing relative movement between the drive member and the backup member such that movement of the stop member within the arcuate slot to the second position provides an indication of the relative movement between the drive member and the driven member.

13. The assembly of claim 12, including a switch that is activated responsive to the movement of the backup member caused by the biasing member, the switch providing a signal indicative of the relative movement between the drive member and the driven member.

14. The assembly of claim 13, wherein the stop member is operative to cause the backup member and the drive member to move synchronously when the stop member is in the second position within the generally arcuate slot.

15. A passenger conveyor drive assembly, comprising:

a motor;

a pulley member driven by the motor;

a belt that moves responsive to movement of the pulley member;

a step chain having a plurality of links that are engaged by the belt such that the step chain moves responsive to movement of the belt; and a backup member that rotates in unison with the pulley member, the backup member engaging a cooperating portion of the step chain and moving relative to the pulley member responsive to relative movement between the step chain and the pulley member.

16. The assembly of claim 15, including a stop member that selectively rotationally locks the backup member to the pulley member such that the motor drives the pulley and backup member to move the step chain as the backup member engages the step chain.

17. The assembly of claim 16, wherein the stop member is secured to the pulley member and the backup member includes a generally arcuate slot through which at least a portion of the stop member is received.

18. The assembly of claim 17, wherein the generally arcuate slot includes a support surface upon which the stop member is received during normal operation of the assembly and an end of the slot on both sides of the support surface, respectively, such that the stop member moves from the support surface to one of the ends during relative movement between the backup member and the pulley member.

19. The assembly of claim 15, including a brake associated with the motor and wherein the brake is actuated responsive to relative movement between the pulley member and the backup member.

20. The assembly of claim 19, including a biasing member that biases the backup member away from the pulley member in a direction parallel to an axis of rotation of the pulley member, the biasing member operating to move the backup member away from the pulley member to active a switch, providing an indication of the relative movement between the pulley member and the backup member.

* * * * *